US005174631A

United States Patent [19]

Schaevitz

[11] Patent Number: 5,174,631

[45] Date of Patent: Dec. 29, 1992

[54] FOOTREST AND STABILIZER

[76] Inventor: Lester P. Schaevitz, 431 N. Latch's La., Merion Station, Pa. 19066

[21] Appl. No.: 771,500

[22] Filed: Oct. 4, 1991

[51] Int. Cl.[5] ..... A47C 16/00

[52] U.S. Cl. ..... 297/438; 297/423; 297/172; 248/188.7

[58] Field of Search ..... 297/423, 438, 429–432, 297/439, 172; 248/188.7; 74/564

[56] References Cited

U.S. PATENT DOCUMENTS

| | | | |
|---|---|---|---|
| 694,538 | 3/1902 | Eddy | 297/432 |
| 1,091,290 | 3/1914 | Carr | 297/423 X |
| 1,368,957 | 2/1921 | Miller | 74/564 |
| 2,854,061 | 9/1958 | Romito | 248/188.7 X |
| 2,935,123 | 5/1960 | Lloyd-Young | 297/433 |
| 3,820,844 | 6/1974 | Fortnam | 297/432 |
| 4,287,835 | 9/1981 | Stratton | 297/439 X |
| 4,767,159 | 8/1988 | Opsvik | 297/172 X |
| 4,767,160 | 8/1988 | Mengshoel et al. | 297/437 X |

FOREIGN PATENT DOCUMENTS

| | | | |
|---|---|---|---|
| 0045151 | 2/1982 | European Pat. Off. | 248/188.7 |
| 783026 | 9/1957 | United Kingdom | 297/438 |
| 2194731 | 3/1988 | United Kingdom | 297/438 |

*Primary Examiner*—Kenneth J. Dorner
*Assistant Examiner*—Milton Nelson, Jr.
*Attorney, Agent, or Firm*—Robert Charles Beam

[57] ABSTRACT

A footrest and stabilizer is shown which provides increased stability to chairs and the like. The footrest and stabilizer is employed with chairs which have a base with five equi-radial support members extending out from a central portion providing support for a seat or the like. The footrest and stabilizer comprises an elongated member attached to one of the support members, and extending back under the central portion. The device also comprises a footrest attached to the elongated member at a beyond the central portion of the chair. A support bracket unites the elongated member with the two support members opposite the support member to which said elongated member is attached, and distributes at least a portion of the forces placed upon the chair by a user.

7 Claims, 2 Drawing Sheets

FOOTREST AND STABILIZER

1. Field of the Invention

The present invention relates to an apparatus providing increased stability to a chair or the like. In particular, the present invention shows a footrest and stabilizer providing increased stability to chairs and the like, which chairs and the like are provided with a base having five support members extending equi-radially outward from a central portion providing support for a seat or the like, wherein the footrest and stabilizer comprise:

an elongated member affixed to one support member at some point along its length, and extending back under said central portion, bisecting the angle formed between the two support members farthest removed from the support member to which said elongated member is attached;

a footrest portion fixedly attached to said elongated member at some suitable distance from said central portion of said chair or the like opposite to the support member to which said elongated member is attached, said footrest being of suitable dimension and shape to accommodate the needs of a user;

a support bracket in mating engagement with said elongated member and the two support members farthest removed from the support member to which said elongated member is attached, said support bracket distributing at least a portion of the forces placed upon said chair or the like by a user.

2. Description of the Prior Art

At various times in industrial and commercial applications, chairs, stools, leaning devices, and/or sit-stands are used by workers who must attend to a repetitive task. Such a task may involve work at a tool bench, a position along a conveyor system, a desk, or even at a counter, such as a supermarket counter.

Standard chairs and devices may not provide sufficient support for the user in such an application and, in particular, the user may not be provided with adequate support when leaning back against the chair or other device. Where such support is important, it is common to permanently affix the chair or other device to the floor. While this solves the support problem somewhat, such a solution introduces new problems, and the chair or other device can no longer be adjusted to accommodate different users.

SUMMARY OF THE INVENTION

It is an object of the present invention to provide increased stability to chairs and the like.

It is a further object of the present invention to provide increased stability to chairs and the like without sacrificing the ability to adjust the chair to the needs of the user.

The other objects, features and advantages of the present invention will become more apparent in light of the following detailed description of the preferred embodiment thereof.

According to the preferred embodiment of the present invention, there is provided a footrest and stabilizer providing increased stability to chairs and the like, which chairs and the like are provided with a base having five support members extending equi-radially outward from a central portion providing support for a seat or the like, wherein the footrest and stabilizer comprise:

an elongated member affixed to one support member at some point along its length, and extending back under said central portion, bisecting the angle formed between the two support members farthest removed from the support member to which said elongated member is attached;

a footrest portion fixedly attached to said elongated member at some suitable distance from said central portion of said chair or the like opposite to the support member to which said elongated member is attached, said footrest being of suitable dimension and shape to accommodate the needs of a user;

a support bracket in mating engagement with said elongated member and the two support members farthest removed from the support member to which said elongated member is attached, said support bracket distributing at least a portion of the forces placed upon said chair or the like by a user.

DETAILED DESCRIPTION OF THE INVENTION

Figure 1:
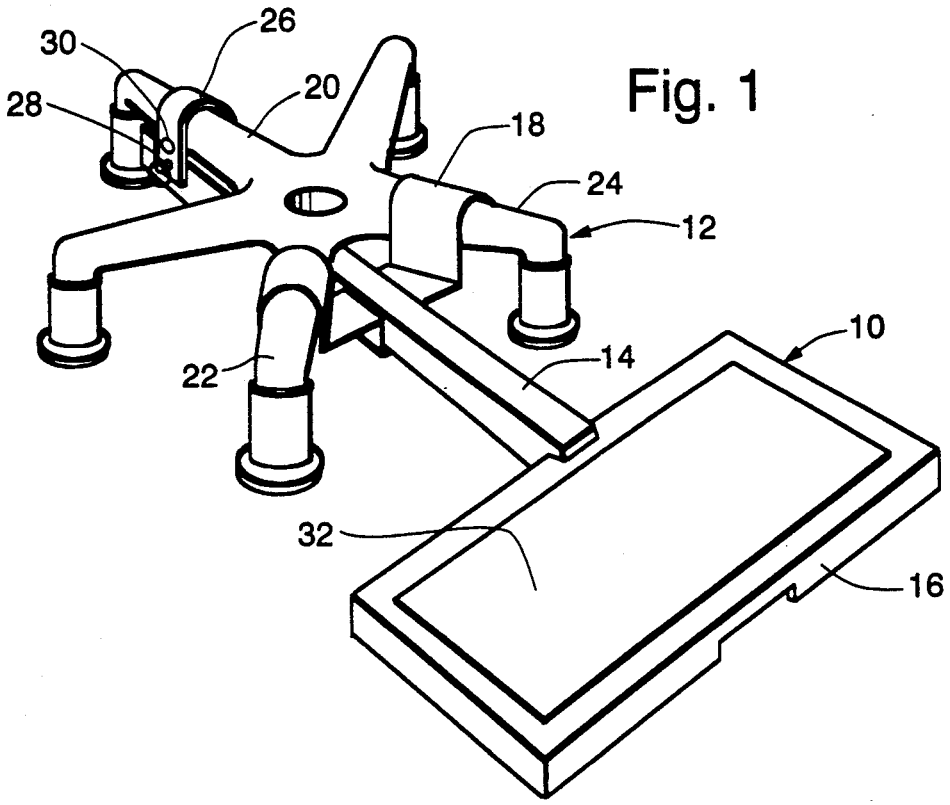
FIG. 1 shows a perspective view of the footrest and stabilizer of the present invention affixed to the base of a chair or other device.

As noted previously, there are many industrial and commercial applications where chairs, stools, leaning devices, and/or sit-stands are used by workers who must attend to a repetitive task. Such a task may involve work at a tool bench, a position along a conveyor system, a desk, or even at a counter, such as a supermarket counter.

Typically, such needs are met with a standard task chair intended for an office environment and, typically, that solution does not fully meet the needs of a user. Other devices are often employed for this purpose as well, and they all have the same shortcoming.

Chairs and other devices will typically have a base with four or five support members extending equi-radially from the center. The longer such support members extend and the greater their number, the greater the support provided to a user. Space and convenience will dictate a compromise on the length and number of such support members, and the typical compromise will be sufficient for most office environments.

In many industrial and commercial environments, however, the compromise of these features which appears to be satisfactory for office environments does not provide sufficient stability. This often occurs where the chair or other device is set high, or with a sit-stand or leaning device where the user places a good deal of force against the device as well as onto it.

This problem has been met with some success by the simple expedient of permanently affixing the chair or other device to the floor of the workplace. Often, however, this no longer allows the chair or other device to be moved to accommodate the comfort of other users.

With the device of the present invention, however, greater stability can be provided to a chair or other device without the necessity of limiting its mobility. This is accomplished, in the preferred embodiment of the present invention, by attaching the device to the base of the chair or other device. This is demonstrated in FIG. 1.

In that drawing, the footrest and stabilizer of the present invention, shown generally as 10, is shown attached to the base 12 of a chair, stool, leaner, or sit-stand, such base having five support members extending equi-radially outward from a central portion providing support for a seat or the like. The footrest and stabilizer 10 is further comprised of an elongated member 14, a footrest portion 16, and a support bracket 18, cooperating together.

The elongated member 14 of the footrest and stabilizer 10 shown in FIG. 1, is preferably affixed to one support member 20 of base 12 at some point along its length, and extends back under the central portion of said base 12 bisecting the angle formed between the two support members, 22 and 24, farthest removed from the support member 20 to which said elongated member 14 is attached.

The elongated member 14 may be fixedly attached in some manner, but in practice it is useful if the footrest and stabilizer 10 of the present invention can be adjusted relative to the base 12 of the chair or other device. In the preferred embodiment this is accomplished by means of attachment bracket 26 secured to the elongated member 14 by attachment pin 28. It has also been found useful to include spacer bar 30, or an equivalent, as part of the assembly, in order to better perform the objects of the invention.

Figure 1A:
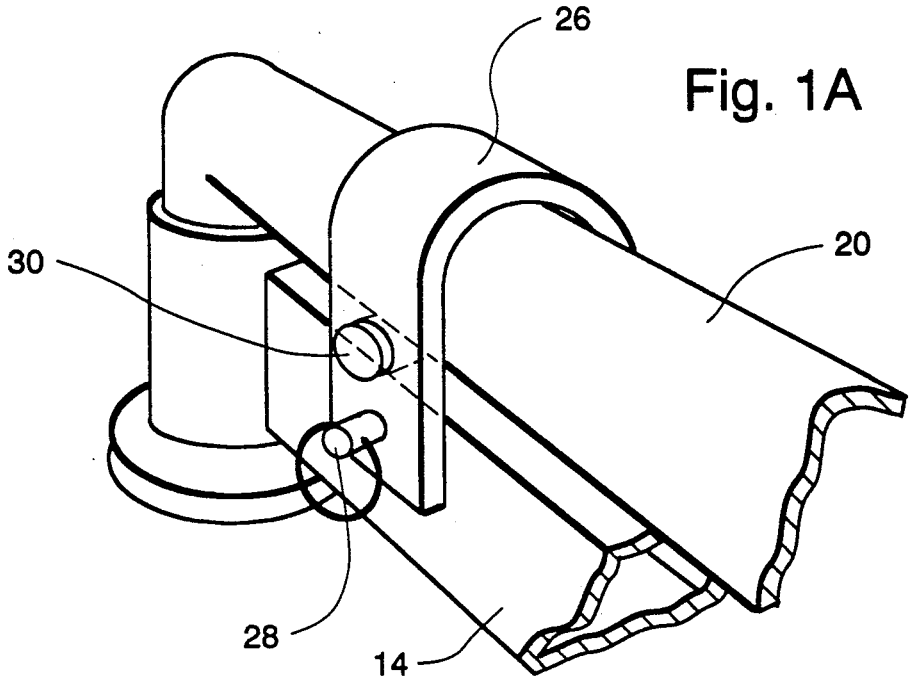
FIG. 1A shows detail from FIG. 1 of the attachment of the elongated member of the footrest and stabilizer of the present invention to a support member of the base.

FIG. 1A shows detail from FIG. 1 of the attachment of the elongated member 14 of the footrest and stabilizer 10 of the present invention to support member 20 of the base 12 of the chair or other device. Attachment pin 28 holds elongated member 14 while spacer 30 maintains its proper position.

A footrest portion 16 is fixedly attached to the elongated member 14 at some suitable distance from the central portion of the base 12 of the chair or other device opposite to the support member 20 to which the elongated member 14 is attached. The footrest portion 16 should be of suitable dimension and shape to accommodate the needs of a user. The footrest portion 16 may also be provided with a surface covering, such as pad 32, which may be selected from a material to prevent slipping, to cushion the users feet, to prevent wear to the footrest portion 16 itself, or some combination of these purposes.

Support bracket 18 is intended to cooperate with elongated member 14 and the two support members, 22 and 24, farthest removed from the support member 20 to which the elongated member 14 is attached. The support bracket may be fixedly attached to the support members 22 and 24, or may simply rest thereon as illustrated in FIG. 1. In this way, support bracket 18 is able to distribute at least a portion of the forces placed upon the chair or other device by a user.

Figure 1B:
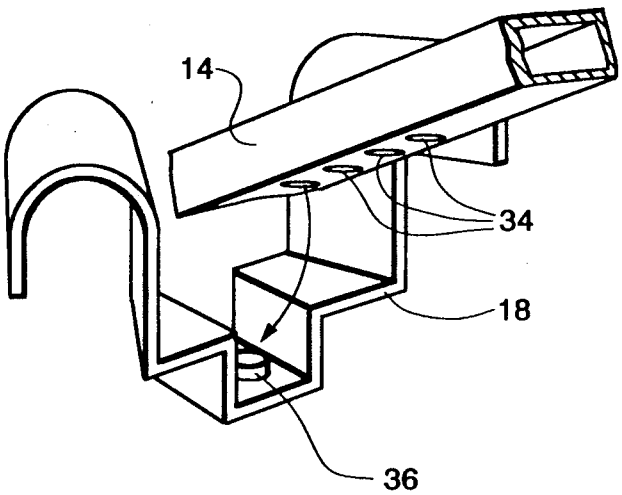
FIG. 1B shows detail from FIG. 1 of junction of the elongated member and the support bracket of the footrest and stabilizer of the present invention, showing particularly the detents, which hold the footrest and stabilizer in position.

FIG. 1B shows detail from FIG. 1 of junction of the elongated member 14 and the support bracket 18 of the footrest and stabilizer 10 of the present invention, showing particularly the detents 34 on the elongated member 14, and the detent pin 36 on the support bracket 18 which interconnect to hold the footrest and stabilizer 10 in the desired position.

Figure 2:
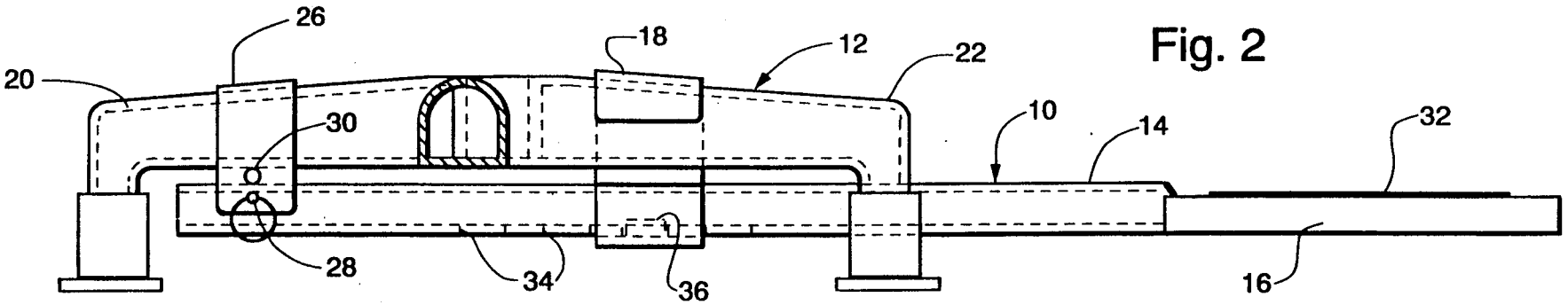
FIG. 2 shows a side plan view of the base of the chair or other device with the footrest and stabilizer of the present invention attached, one leg of the chair base having been omitted to permit a clear view.

FIG. 2 shows a side plan view of the base of the chair or other device with the footrest and stabilizer of the present invention attached, one leg of the chair base having been omitted to permit a clear view. As will be seen in this drawing, the footrest and stabilizer 10 of the present invention is affixed beneath the base 12 of a chair or other device, and is comprised of an elongated member 14, a footrest portion 16, and a support bracket 18.

Elongated member 14 is attached to support member 20 of the base 12 by means of attachment bracket 26 and attachment pin 28. Spacer 30 is interpositioned between elongated member 14 and the bottom of support member 20 of base 12 to hold the elongated member 14 in the preferred position.

As shown in FIG. 2, elongated member 14 extends back under the central portion of base 12, bisecting the angle formed between the two support members farthest removed from the support member 20 to which the elongated member 14 is attached. A footrest portion 16 is fixedly attached to the elongated member 14 at some suitable distance from the central portion of the base 12 opposite to the support member 20 to which the elongated member 14 is attached. The footrest portion 16 should be of suitable dimension and shape to accommodate the needs of a user. In FIG. 2 also, the footrest portion 16 is further provided with a padding 32 to accommodate the needs of a user.

Support bracket 18 is shown in mating engagement with the elongated member 14 and the two support members, 22 and 24, of base 12 farthest removed from support member 20 to which said elongated member 14 is attached. The support bracket 18 distributes at least a portion of the forces placed upon the chair or other device by a user.

Other features, advantages, and specific embodiments of this invention will become readily apparent to those exercising ordinary skill in the art after reading the foregoing disclosures. These specific embodiments are within the scope of the claimed subject matter unless otherwise expressly indicated to the contrary. Moreover, while specific embodiments of this invention have been described in considerable detail, variations and modifications of these embodiments can be effected without departing from the spirit and scope of this invention as disclosed and claimed.

What I claim is:

1. A footrest and stabilizer providing increased stability to chairs, which chairs are provided with a base having five support members extending equiradially outward from a central portion such that each pair of contiguous support members are separated by an angle of approximately seventy-two degrees (72°) forming a star shaped pattern of support members in which the continuation of any first support member through said central portion would bisect the angle formed between the pair of two opposite support members farthest removed from said first support member providing support for a seat, wherein the footrest and stabilizer comprise:

an elongated member affixed to a first (one) support member at some point along its length, and extending back under said central portion, bisecting the angle formed between the pair of two opposite support members farthest removed from said first (the) support member to which said elongated member is attached;

a footrest portion fixedly attached to said elongated member at some suitable distance from said central portion of said chair opposite to the support member to which said elongated member is attached, said footrest being of suitable dimension and shape to accommodate (accomodate) the needs of a user;

a support bracket in mating engagement with said elongated member and the two support members farthest removed from the support member to which said elongated member is attached, said support bracket distributing at least a portion of any forces placed upon said chair by a user.

2. The footrest and stabilizer of claim 1 wherein the elongated member is attached to said first support member by means of a bracket and pin.

3. The footrest and stabilizer of claim 1 wherein the elongated member is provided with a spacer at its point of contact with said first support member of said base.

4. The footrest and stabilizer of claim 1 wherein the elongated member is provided with at least one detent to assist in positioning the device relative to a chair.

5. The footrest and stabilizer of claim 1 wherein the footrest portion is a rectangle in shape.

6. The footrest and stabilizer of claim 1 wherein the footrest portion is further provided with a padding.

7. The footrest and stabilizer of claim 1 wherein the support bracket is further provided with a detent pin to cooperate with detents of said elongated member to assist in positioning relative to a chair.

* * * * *